US006394424B2

(12) United States Patent
Pattullo et al.

(10) Patent No.: US 6,394,424 B2
(45) Date of Patent: May 28, 2002

(54) CARBURETOR WITH DIAPHRAGM TYPE FUEL PUMP

(75) Inventors: George M. Pattullo, Caro; Thomas L. Schmidt, Cass City, both of MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/873,631

(22) Filed: Jun. 4, 2001

Related U.S. Application Data

(63) Continuation-in-part of application No. 09/587,861, filed on Jun. 6, 2000, now abandoned.

(51) Int. Cl.[7] ..... F02M 7/093

(52) U.S. Cl. ..... 261/35; 261/44.8; 261/69.1; 261/DIG. 68

(58) Field of Search ..... 261/35, 69.1, 69.2, 261/44.8, DIG. 68, DIG. 21

(56) References Cited

U.S. PATENT DOCUMENTS 2,801,621 A * 8/1957 Anderson et al. .... 261/DIG. 68
3,441,010 A * 4/1969 Barr et al. ..... 261/35 X
4,159,012 A * 6/1979 Pizzuto et al. ..... 261/35 X
4,230,646 A * 10/1980 Ghizzoni ..... 261/DIG. 68
4,481,152 A * 11/1984 Kobayashi et al. ..... 261/35
4,787,356 A * 11/1988 Rosgen et al. ..... 261/DIG. 68
4,944,272 A * 7/1990 Carlsson et al. ..... 261/DIG. 68
5,711,901 A * 1/1998 Berg et al. ..... 261/35
5,743,240 A * 4/1998 Zerrer et al. ..... 261/35 X
5,843,345 A * 12/1998 Guntly ..... 261/34.2

OTHER PUBLICATIONS

* Reference Checked was Cited in Specification.*

* cited by examiner

*Primary Examiner*—Richard L. Chiesa
(74) *Attorney, Agent, or Firm*—Reising, Ethington, Barnes, Kisselle, Learman & McCulloch, PC

(57) ABSTRACT

For a four-stroke engine, a carburetor with a fuel pump diaphragm which defines a fuel pump chamber on one side and a pressure pulse chamber on its other side in communication with the engine to receive pressure pulses which actuate the fuel pump diaphragm to draw fuel into the carburetor and to discharge fuel under pressure to a downstream fuel metering assembly. An air passage communicates an air supply with the pressure pulse chamber to provide an air flow within the pressure pulse chamber which sweeps away, dries out or aerates and removes any liquid fuel within the pressure pulse chamber to avoid puddling of liquid fuel therein. In one form, a throttle valve carried by the carburetor body for movement between idle and wide open positions also actuates a valve which controls the flow of fluid through the air passage as a function of the position of the throttle valve.

32 Claims, 8 Drawing Sheets

CARBURETOR WITH DIAPHRAGM TYPE FUEL PUMP

REFERENCE TO CO-PENDING APPLICATION

This is a continuation-in-part of U.S. patent application Ser. No. 09/587,861, filed on Jun. 6, 2000, now abandoned.

FIELD OF THE INVENTION

This invention relates to carburetors and more particularly to carburetors having a diaphragm type fuel pump.

BACKGROUND OF THE INVENTION

Carburetors are currently used to provide the combustion fuel requirements for a wide range of two-cycle and four-cycle engines including hand held engines, such as engines for chainsaws and weed trimmers, as well as a wide range of marine engine applications. Diaphragm type carburetors are particularly useful for hand held engine applications wherein the engine may be operated in substantially any orientation, including upside-down. These carburetors utilize a fuel-metering diaphragm which is operative to control the delivery of fuel from the carburetor regardless of its orientation. Additionally, some carburetors utilize a diaphragm type fuel pump which is responsive to engine pressure pulses to draw fuel from a fuel supply and to deliver fuel to the fuel metering assembly under pressure. The fuel pump diaphragm defines a fuel chamber on one side which receives liquid fuel and a pressure pulse chamber on its other side in communication with the engine to receive pressure pulses which actuate the fuel pump diaphragm.

In two-stroke engines, the pressure pulse chamber usually communicates with the crankcase and alternately receives negative and positive pressure pulses to actuate the fuel pump diaphragm.

In four-stroke engines, the pressure pulse chamber is communicated with an intake manifold of the engine which provides a predominantly negative or vacuum pressure signal to actuate the fuel pump diaphragm. This pressure signal from the intake manifold contains fuel vapor which may condense to liquid fuel and collect forming a puddle of liquid fuel in the pressure pulse chamber. Undesirably, this puddle of liquid fuel may be dumped directly into the engine intake manifold when the orientation of the carburetor is changed, or may be rapidly drawn into the engine when the engine speed is rapidly reduced from wide open throttle to idle. This results in an excessively rich fuel condition within the engine which severely affects the stability of the engine, especially at idle, and may even cause the engine to stall. Further, the puddle of liquid fuel within the pressure pulse chamber can adversely affect the performance of the fuel pump. These problems are particularly acute in small four-stroke engines which are highly sensitive to a richer than desired fuel and air mixture provided to the engine.

SUMMARY OF THE INVENTION

A carburetor for a four-stroke engine has a body which carries a fuel pump diaphragm which defines a fuel pump chamber on one side and a pressure pulse chamber on its other side in communication with the engine to receive pressure pulses which actuate the fuel pump diaphragm to draw fuel into the carburetor and to discharge fuel to a downstream fuel metering assembly under pressure. An air passage communicates at one end with an air supply and at its other end with the pressure pulse chamber to provide an air flow within the pressure pulse chamber which sweeps away, dries out, disperses or aerates any liquid fuel within the pressure pulse chamber to avoid puddling or accumulation of liquid fuel therein.

In one embodiment, a throttle valve carried by the carburetor body for movement between idle and wide open positions controls the flow of fluid through the air passage as a function of the position of the throttle valve. Desirably, the air passage is open when the throttle valve is in its idle position to provide the air flow into the pressure pulse chamber and to prevent liquid fuel from puddling in the pulse chamber so that liquid fuel is not dumped into the engine intake manifold from the pressure pulse chamber. Due to the large magnitude of the vacuum communicated with the pressure pulse chamber when the engine is idling, the flow of air into the pressure pulse chamber from the air passage does not significantly or materially affect the performance of the fuel pump. Conversely, at wide open throttle the flow of air into the pressure pulse chamber may adversely affect the efficiency of the fuel pump which needs to pump significantly more fuel than at idle to satisfy the engine's fuel demand at wide open throttle. Therefore, in at least some applications, it is desirable to close off the air passage when the throttle valve moves to its wide-open position to avoid adverse affects on the diaphragm fuel pump. At high engine speeds, if liquid fuel collects within the pressure pulse chamber and is discharged therefrom into the engine, the engine is not likely to stall because it is more tolerant of a rich fuel mixture when operating at wide open throttle and high speed conditions.

Objects, features and advantages of this invention include providing a carburetor which is ideally suited for small four-stroke engines, reduces or eliminates puddling of liquid fuel in a pressure pulse chamber of the diaphragm fuel pump at least during idle engine operation, eliminates a puddle of fuel from being dumped into the intake manifold at least during idle engine operation, permits the engine to be initially started and operated with a richer fuel and air mixture desirable for starting and warming up of the engine, increases the tolerance of the carburetor to be operated in substantially any orientation even during idle engine operation, does not significantly effect the performance of the fuel pump, provides more consistent fuel pump performance, improves the idle operation and stability of the engine, eliminates engine stall when the engine is rapidly changed from wide open throttle operation to idle operation, is applicable to substantially any carburetor design, is of relatively simple design, economical manufacture and assembly, rugged, reliable, durable and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
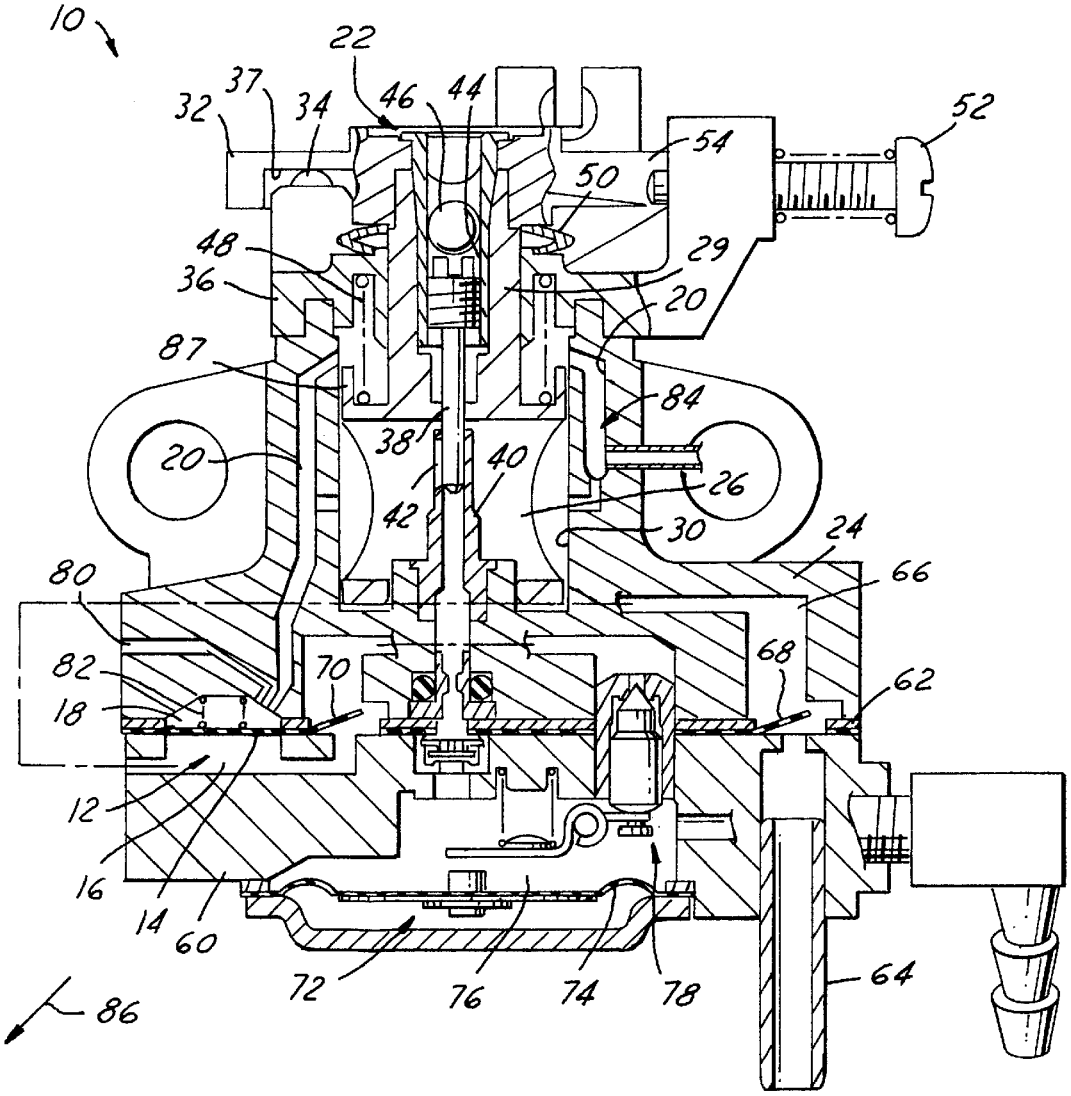
FIG. 1 is a diagrammatic sectional view of a carburetor embodying the present invention and having a rotary throttle valve shown in its idle position.
Figure 2:
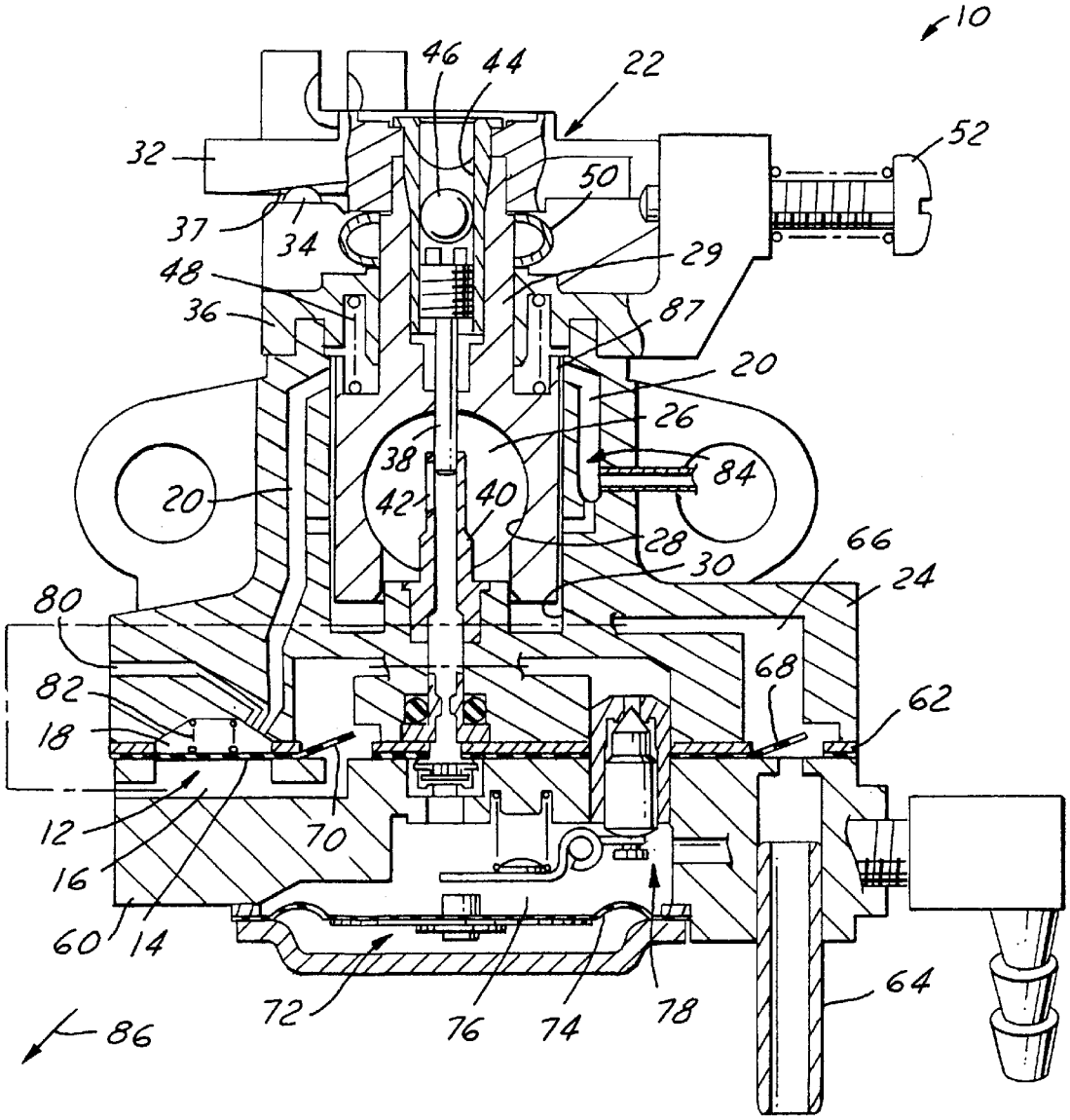
FIG. 2 is a diagrammatic sectional view of the carburetor of FIG. 1 with the rotary throttle valve in its wide-open position.

Referring in more detail to the drawings, FIGS. 1 and 2 illustrate a rotary throttle valve type carburetor 10 having a fuel pump 12 with a diaphragm 14 defining in part a fuel chamber 16 on one side and a pressure pulse chamber 18 on its other side. An air passage 20 in communication with a supply of fresh air at one end and with the pressure pulse chamber 18 at its other end provides an air flow to the pressure pulse chamber 18 which reduces or eliminates the collection or puddling of liquid fuel in the pressure pulse chamber 18. By eliminating the puddling of liquid fuel within the pressure pulse chamber 18, the orientation of the carburetor 10 can be changed and the engine speed can be rapidly reduced from wide open throttle to idle without discharging a puddle of fuel from the pressure pulse chamber 18 into the engine intake manifold, which is extremely detrimental to the operation of small four-stroke engines. Desirably, in one form movement of a throttle valve 22 from its idle position to its wide open position closes off the air passage 20 to prevent the air flow to the pressure pulse chamber 18 at wide open throttle to avoid any detrimental effects on the fuel pump 12 performance.

The carburetor 10 has a main body 24 with a fuel and air mixing passage 26 formed therethrough and the rotary throttle valve 22 is disposed in the fuel and air mixing passage 26. The throttle valve 22 has a through bore 28 selectively and progressively aligned with the fuel and air mixing passage 26 as the throttle valve 22 is moved between idle and wide open positions to control the flow of air and fuel through the carburetor 10. The throttle valve 22 is preferably a generally cylindrical shaft 29 rotatably received in a complementary bore 30 in the body 24 extending generally transversely to the fuel and air mixing passage 26. At one end, the throttle valve 22 has a follower plate 32 extending generally radially outwardly therefrom and engageable with a cam post or ball 34 carried by a throttle valve plate 36 of the carburetor body 24. The follower 32 has a generally sloped cam surface or ramp 37 to impart axial movement of the throttle valve 22 as the throttle valve is rotated between its idle and wide open positions. This axial movement of the throttle valve 22 moves a needle 38 carried by the throttle valve 22 relative to a fuel jet 40 carried by the carburetor body 24 to vary the size of an orifice 42 of the fuel jet 40 to thereby control, at least in part, the amount of fuel discharged from the orifice 42. For calibration purposes, the needle 38 is preferably threaded into a complementary bore 44 in the throttle valve 22 and its position can be altered relative to the throttle valve 22 by rotating it. A spherical ball or plug 46 can be press fit into the bore 44 to prevent access to the needle 38 after it has been initially calibrated.

The throttle valve plate 36 traps a coil spring 48 against the throttle valve 22 to provide a force biasing the throttle valve 22 axially downward in its bore 30 (as viewed in FIGS. 1 and 2). An annular flexible seal 50 is disposed around an upper portion of the throttle valve 22 to provide a liquid tight seal between the throttle valve 22 and throttle valve plate 36. An idle adjustment screw 52 is threadably received in the throttle valve plate 36 and is adapted to engage a radially outwardly extending flange 54 fixed to the throttle valve 22 to positively position the throttle valve 22 in a desired idle position. As thus far described, the rotary throttle valve 22, throttle valve plate 36 and fuel jet 40 may be of conventional construction to control the flow of fuel and air through the carburetor 10.

The fuel pump 12 comprises the fuel pump diaphragm 14 trapped between an end plate 60 and the carburetor body 24 with a gasket 62 preferably received between the diaphragm 14 and main carburetor body 24. A fuel inlet fitting 64 is press fit into the end plate 60 and communicates with the fuel chamber 16 through an internal passage 66 of the carburetor body 24 with a flap type inlet valve 68, preferably integral with the fuel pump diaphragm 14, preventing the reverse flow of fuel. Fuel which flows through the inlet valve 68 enters the fuel chamber 16 defined in part by the fuel pump diaphragm 14. Fuel discharged from the fuel chamber 16 flows through an outlet valve 70 which is also preferably a flap type valve integral with a fuel pump diaphragm 14. From there, fuel flows to a conventional fuel metering assembly 72 having a fuel metering diaphragm 74, fuel metering chamber 76 and a diaphragm controlled inlet valve 78 which selectively permits fuel flow into the fuel metering chamber 74. From the fuel metering chamber 74, the fuel flows to the fuel jet 40 and into the fuel and air mixing passage 26 in response to a differential pressure across the fuel jet 40, in a known manner. The fuel metering assembly 72 may be as disclosed in U.S. Pat. No. 5,711,901 the disclosure of which is incorporated herein by reference in its entirety.

The pressure pulse chamber 18 is defined on the other side of the fuel pump diaphragm 14 and communicates with the engine intake manifold through a pressure pulse passage 80. Engine pressure pulses from the intake manifold are thus communicated with the pressure pulse chamber 18 to vary the pressure therein. Notably, with four-stroke engines, the pressure pulse is predominantly negative or a vacuum pressure which tends to displace the fuel pump diaphragm 14 in a direction tending to increase the volume of the fuel chamber 16 to draw fuel therein. A spring 82 which is preferably a helical coil spring, provides a biasing or return force which tends to displace the fuel pump diaphragm 14 in a direction tending to decrease the volume of the fuel chamber 16 to discharge fuel from the fuel chamber 16 under pressure. In this manner, the displacement of the fuel pump diaphragm 14 draws fuel into the carburetor 10 and discharges fuel under pressure to the fuel metering assembly 72 it is made available to the engine corresponding to the engine's fuel demand.

In accordance with the present invention, an air passage 20 is provided which communicates at one end with a fresh air source and at its other end with the pressure pulse chamber 18 to provide a flow of air through the pressure pulse chamber 18 which disperses, aerates, sweeps away or dries out any liquid fuel in the pressure pulse chamber 18 and prevents puddling of liquid fuel therein. The air passage 80 may be routed externally of the carburetor 10, for instance, through an external conduit leading from a location downstream of an air filter and extending directly into the pressure pulse chamber 18. Alternatively, the air passage 20 can be routed from a point downstream of the air filter to an internal portion 84 within the carburetor body 24 which leads to the pressure pulse chamber 18 to provide the air flow therein. The air passage 20 may open into and communicate with the pressure pulse passage 80 which in turn communicates with the pressure pulse chamber 18. Desirably, air from the air passage 20 enters the pressure pulse chamber 18 and exits through the pressure pulse passage 80 at the same general location in the pressure pulse chamber 18 which is preferably at or near the lowest point of the pressure pulse chamber 18 relative to the standard operating position of the carburetor which is indicated by arrow 86 in FIGS. 1 and 2. Supplying the air into the pressure pulse chamber 18 at its lowest point relative to the standard operating position helps to ensure any liquid fuel which puddles and collects at the lowest point of the chamber 18 is dispersed, swept away, aerated or otherwise reduced, removed or eliminated from the pressure pulse chamber 18.

As shown in FIG. 1, a portion of the air passage 20 preferably extends through the throttle valve bore 30. When the throttle valve 22 is in its idle position, it is spaced from the air passage 20 and air may flow through the air passage 20 to the pressure pulse chamber 18. However, as shown in FIG. 2, when the throttle valve 22 is rotated and axially moved to its wide open throttle position a cylindrical upper portion 87 of the throttle valve 22 blocks off the air passage 20 to at least substantially restrict the flow of air therethrough. Hence, the throttle valve 22 also acts as a second valve which controls the air flow through the air passage 20 in addition to controlling the flow through the fuel and air mixing passage 26. Preventing the flow of air from the air passage 20 to the pressure pulse passage 18 at wide open throttle is desirable to prevent the dilution or reduction of the pressure pulses actuating the fuel pump diaphragm 14 to prevent any adverse impact on the pumping capability of the fuel pump 12 at wide open throttle when the engine has its maximum fuel demand. During idle engine operation, there is a strong vacuum or pressure pulse signal supplied to the pressure pulse chamber 18, and therefore the air flow through the air passage 20 does not significantly or materially affect the pumping capability of the fuel pump 12. Further, the fuel required by the engine during idle operation is significantly less than that required at wide open throttle operation.

Figure 3:
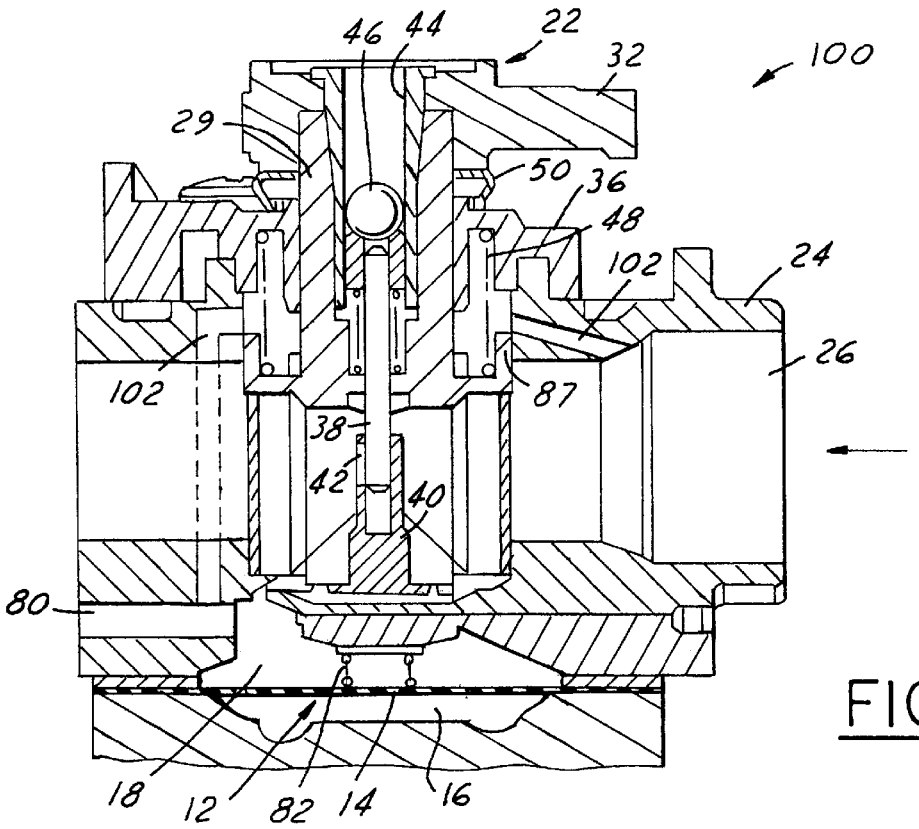
FIG. 3 is a sectional view of a slightly modified carburetor similar to that of FIGS. 1 and 2, illustrating a second embodiment of the invention and having its rotary throttle valve in its idle position.
Figure 4:
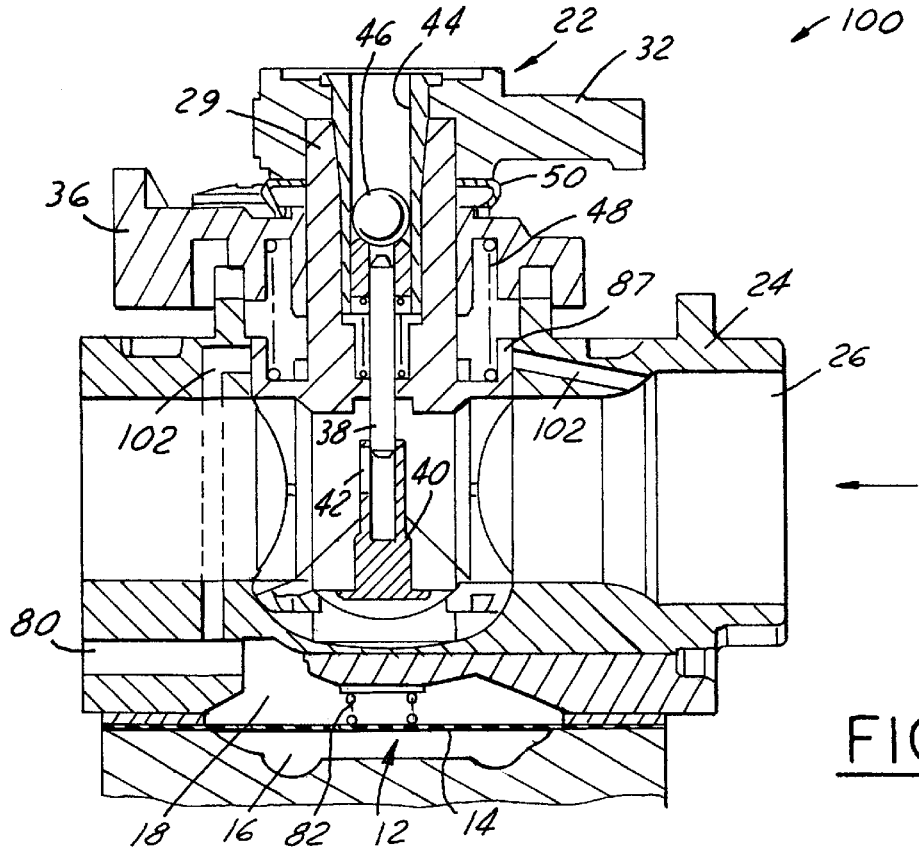
FIG. 4 is a sectional view of the carburetor of FIG. 3 illustrating the rotary throttle valve in its wide-open position.

A second embodiment of a carburetor 100 is shown in FIGS. 3 and 4. In this carburetor 100, an air passage 102 communicates at one end with an upstream portion of the fuel and air mixing passage 26 and at its other end with the pressure pulse passage 80 which opens to the pressure pulse chamber 18 to divert some of the air which flows into the fuel and air mixing passage 26 to the pressure pulse chamber 18. As shown in FIG. 3, the air passage 102 is open when the throttle valve 22 is in its idle position and as shown in FIG. 4, is essentially closed when the throttle valve 22 is rotated to its wide open position, in the same manner as described for the embodiment of FIGS. 1 and 2. Compared to the first embodiment of carburetor 10, the fuel pump 12 is in a slightly different location in this carburetor 100 and the fuel metering assembly is in a lower portion of the carburetor 100 which is not shown. In all other respects, the carburetor 100 of FIGS. 3 and 4 is the same as that of FIGS. 1 and 2 and hence, will not be described further.

Figure 5:
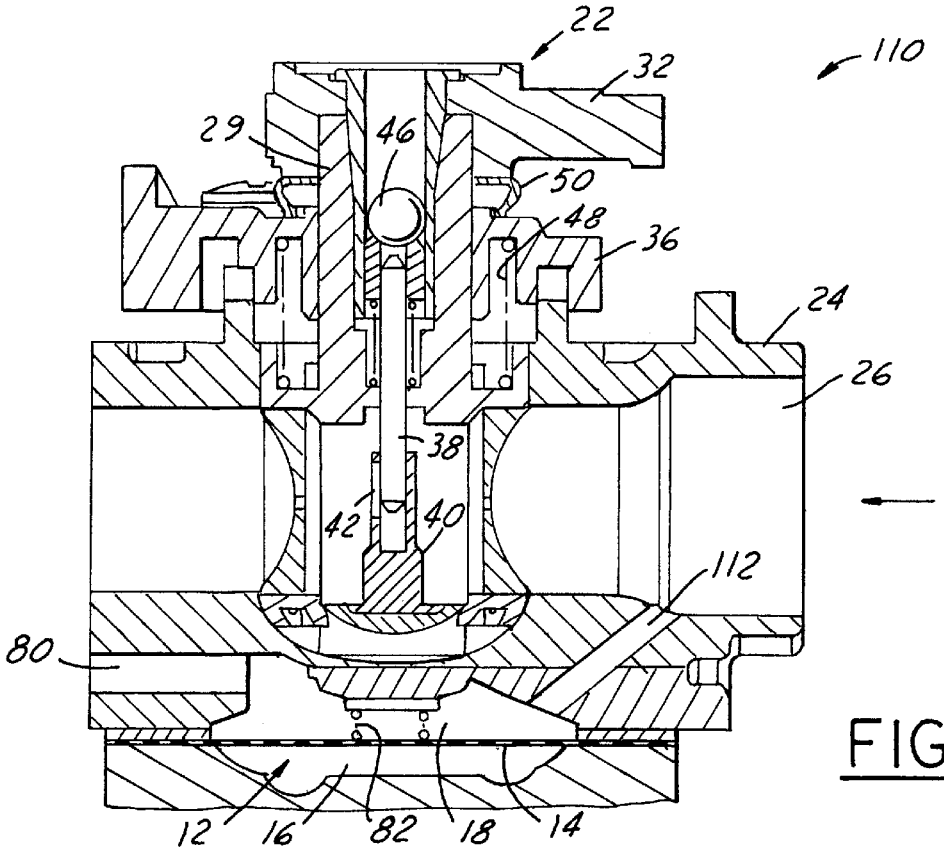
FIG. 5 is a cross sectional view of a carburetor according to a third embodiment of the invention.

A carburetor 110 according to a third embodiment of the present invention is shown in FIG. 5. This carburetor 110 is constructed in substantially the same manner as the embodiment of FIGS. 3 and 4 with the exception that its air passage 112 is not routed through the throttle valve bore 30. Rather, in this embodiment, the air passage 112 is open at one end to the fuel and air mixing passage 26 and is open at its other end directly into the pressure pulse chamber 18. Thus, the air passage 112 remains open regardless of the position of the throttle valve 22 to supply an air flow into the pressure pulse chamber 18 at all times while the engine is operating. In all other respects, the third embodiment carburetor 110 is constructed substantially the same as that of the first and second embodiments of carburetors 10, 100 and hence, will not be described further.

Figure 6:
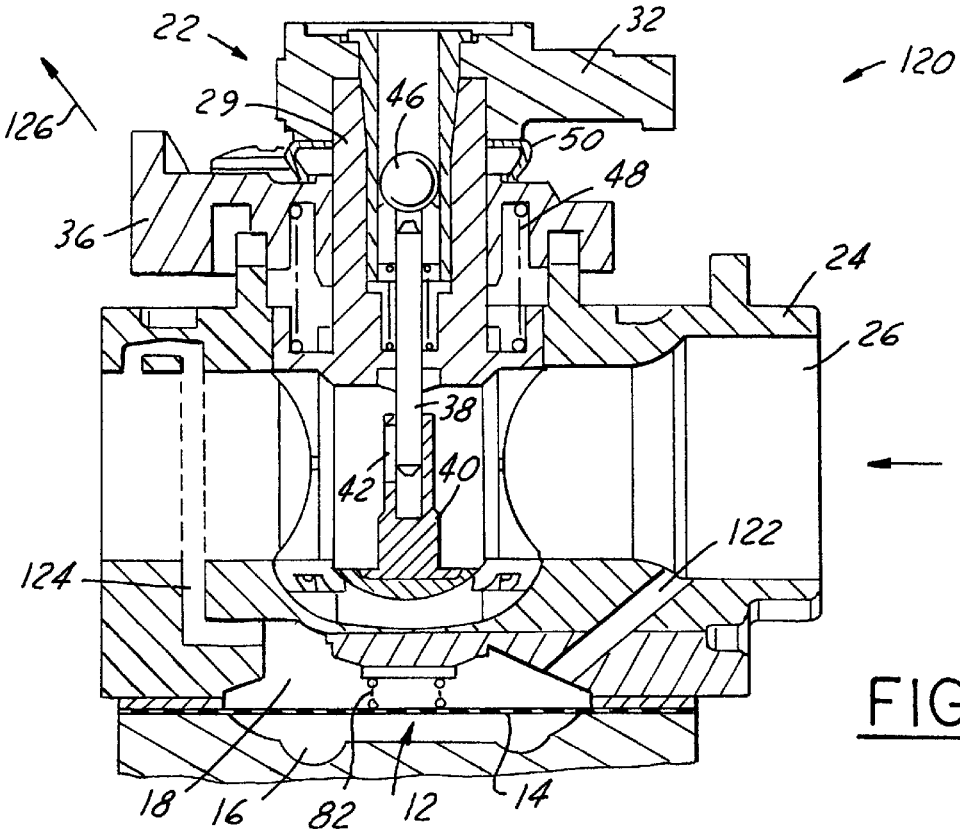
FIG. 6 is a sectional view of a carburetor according to a fourth embodiment of the invention.

As shown in FIG. 6, a carburetor 120 according to a fourth embodiment of the present invention has an air passage 122 constructed in the same manner as that of the third embodiment carburetor 110 and which is always open regardless of the position of the throttle valve 22. In this embodiment of the carburetor 122, the pressure pulse passage 124 is open at one end to the fuel and air mixing passage 26 and at its other end to the pressure pulse chamber 18. Therefore, the engine pressure pulses are communicated with the pressure pulse chamber 18 through the fuel and air mixing passage 26. Desirably, the pressure pulse passage 124 opens into the fuel and air mixing passage 26 at the highest point of the fuel and air mixing passage 26 relative to the standard operating position of the carburetor, which is indicated at arrow 126 in FIG. 6. The pressure pulse passage 124 is communicated with the highest point of the fuel and air mixing passage 26 to inhibit the flow of liquid fuel from the fuel and air mixing passage 26 into the pressure pulse chamber 18 by forcing any air and fuel vapor to reverse flow from the highest point in the fuel and air mixing passage 26 upwardly into the pressure pulse passage 124 before entering the pressure pulse chamber 18. In all other respects, the fourth embodiment carburetor 120 is constructed in the same manner as the third embodiment carburetor 110 and hence, will not be described further.

Figure 7:
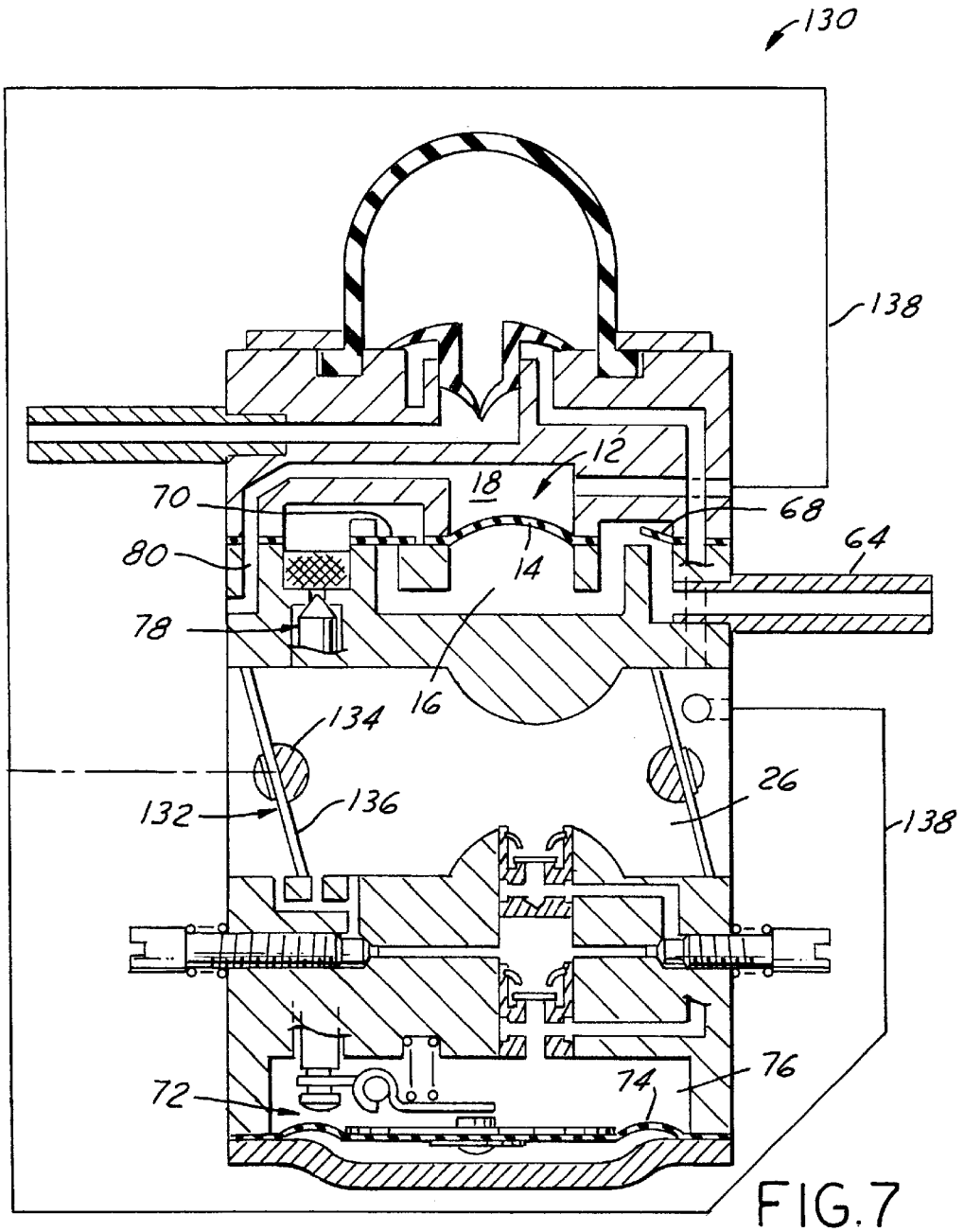
FIG. 7 is a diagrammatic sectional view of a carburetor according to a fifth embodiment of the invention and having a butterfly-type throttle valve.

As shown in FIG. 7, a fifth embodiment of a carburetor 130 has a fuel pump 12 which functions in the same manner as the fuel pump 12 of the first embodiment of the carburetor 10 to draw fuel into the fuel chamber 16 and to discharge it under pressure to a fuel metering assembly 72 from which it is available to be drawn into a fuel and air mixing passage 26 of the carburetor 130 for delivery to the engine. A butterfly type throttle valve 132 is disposed within the fuel and air mixing passage 26 to control the flow of fuel and air through the carburetor 130. The throttle valve 132 comprises a shaft 134 rotatably carried by the carburetor body 24 and a disk shaped valve head 136 fixed to the shaft 134 such as by a screw. The throttle valve 132 is rotated between an idle position wherein the valve head 136 extends generally transversely to the axis of the fuel and air mixing passage 26, and a wide open position wherein the valve head 136 is generally parallel to the axis of the fuel and air mixing passage 26.

Figure 7A:
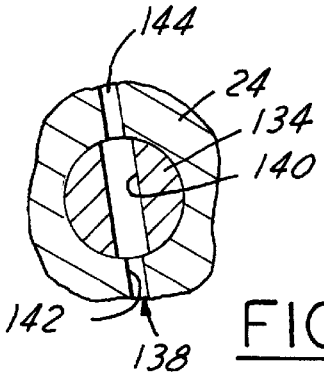
FIG. 7A is an enlarged fragmentary sectional view illustrating a throttle valve shaft of the carburetor of FIG. 7 in its idle position.
Figure 7B:
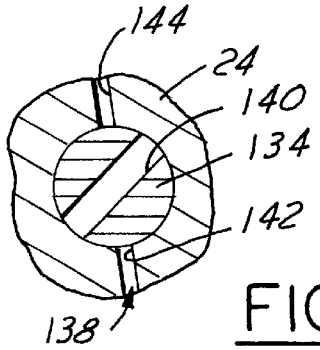
FIG. 7B is an enlarged fragmentary sectional view illustrating a throttle valve shaft of the carburetor of FIG. 7 in its wide-open position.

An air passage 138 (shown diagrammatically) is open at one end to the fuel and air mixing passage 26 and at its other end to the pressure pulse chamber 18 of the fuel pump 12 to provide a flow of air into the pressure pulse chamber 18, during at least some engine operating conditions, to eliminate puddling of liquid fuel within the pressure pulse chamber 18. As best shown in FIGS. 7A and 7B, a portion of the air passage 138 is defined by a hole 140 extending through the throttle valve shaft 134. As shown in FIG. 7A, when the throttle valve 132 is in its idle position, the hole 140 through the throttle valve shaft 134 is aligned with the adjacent portions 142, 144 of the air passage 138, along either side of the throttle valve shaft 134, to permit fluid flow therethrough. Conversely, as shown in FIG. 7B, when the throttle valve 132 is rotated sufficiently toward its wide open position, the hole 140 through the throttle valve shaft 134 is rotated out of alignment with the adjacent portions 142, 144 of the air passage 138 to at least substantially restrict or prevent fluid flow through the air passage 138 to the pressure pulse chamber 18. The air passage 138 is indicated diagrammatically in FIG. 7 and is shown externally of the carburetor 130, but it is preferably formed by an internal passage extending through the carburetor body 24. In any event, in a similar manner as that of the first and second embodiments of the carburetors 10, 100 movement of the throttle valve 132 from its idle position to its wide open position closes the air passage 138 to prevent or at least substantially restrict flow of air to the pressure pulse chamber 18. The remainder of this fifth embodiment of the carburetor 130 is constructed and functions in substantially the same manner as the first embodiment of the carburetor 10 and hence, its construction and function will not be described further.

Figure 8:
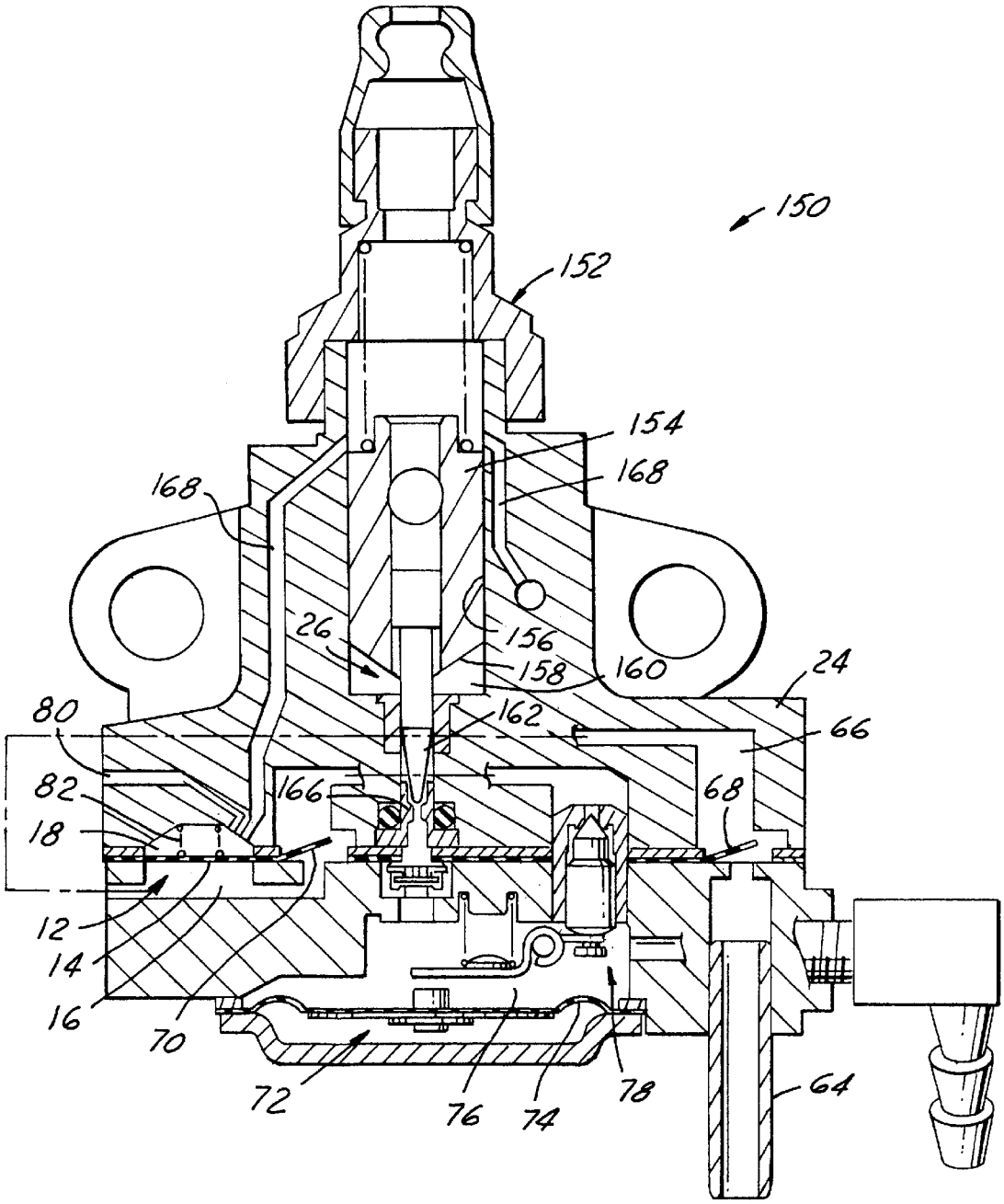
FIG. 8 is a diagrammatic sectional view of a carburetor according to a sixth embodiment of the invention and having a slide-type throttle valve.

As shown in FIG. 8, the present invention is equally applicable to a carburetor 150 having a slide type throttle valve 152. In this sixth embodiment of the carburetor 150, the throttle valve 152 has a generally cylindrical shaft 154 received in a complementary bore 156 in the carburetor body 24 and axially slidably displaceable by a suitable throttle lever to alter the position of the throttle valve 152 relative to the fuel and air mixing passage 26. At idle, a generally frustoconical lower end 158 of the throttle valve shaft 154 provides a gap 160 and permits a desired air flow through the fuel and air mixing passage 26. At wide open throttle, the shaft 154 is pulled outwardly from the carburetor body 24 to increase the flow area of the gap 160 to control the flow of fuel and air in the fuel and air mixing passage 26 in proportion to the engine's fuel demand. Axial displacement of the throttle valve 152 also moves a needle 162 carried by the shaft 154 relative to a fuel jet or valve seat 166 to control the flow of fuel into the fuel and air mixing passage 26 in a conventional manner.

Similar to the first embodiment of the carburetor 10, an air passage 168 which communicates an air supply with the pressure pulse chamber 18 is routed through the throttle valve bore 156. When the throttle valve 152 is in its idle position, as shown in FIG. 8, the air passage 168 is open to provide a flow of air to the pressure pulse chamber 18 which eliminates the puddling of liquid fuel therein. When the throttle valve 152 is axially displaced to its wide open position, the air passage 168 is essentially blocked off or at least substantially restricted by the shaft 154 to eliminate or substantially reduce the flow of air to the pressure pulse chamber 18 at wide open throttle engine operation. In all other respects, the carburetor 150 of the sixth embodiment functions in substantially the same manner as the previous embodiments and hence, will not be described further.

Therefore, in each embodiment of the carburetor 10, 100, 110, 120, 130, 150, an air passage 20, 102, 112, 122, 138, 168 is communicated with the pressure pulse chamber 18 of the fuel pump 12 to reduce, eliminate or prevent the puddling of liquid fuel in the pressure pulse chamber 18 and to remove fuel from the chamber 18. In some embodiments 110, 120, the air passage 110, 120 remains open regardless of the position of the throttle valve of the carburetor 110, 120 and in other embodiments 10, 100, 130, 150, the throttle valve or shaft defines in part or actuates an air passage valve which selectively controls the flow of fluid through the air passage 20, 102, 138, 168 into the pressure pulse chamber 18 in a desired manner. Preferably, the air passage 20, 102, 138, 168 remains open at idle engine operation and actuation of the throttle valve 22, 132, 152 closes the air passage at least at wide open throttle engine operation to prevent adversely affecting the pressure pulse signal applied to the fuel pump diaphragm 14 at wide open throttle engine operation wherein the engine has its greatest fuel demand and usually vacuum pulses of minimum magnitude. The air passage valve may if desired, gradually close the air passage as the throttle valve is rotated towards its wide open position, or it may close the air passage rather quickly and well before the throttle valve reaches its filly wide open position. At idle engine operation, a large magnitude vacuum is applied to the pressure pulse chamber 18 and the fuel pump 12 has to deliver significantly less fuel than at wide open throttle such that application of the air flow from the air passage into the pressure pulse chamber 18 does not significantly or materially adversely affect the engine operation.

To control the flow of air through the air passage 20, 102, 112, 122, 138, 168 and into the pressure pulse chamber 18 relative to the pressure pulse communicated with the pressure pulse chamber 18, the ratio of the minimum diameter of the air passage 20, 102, 112, 122, 138, 168 to the minimum diameter of pressure pulse passage 80, 124 is between 0.05:1 and 1.5:1 and preferably between 0.25:1 and 1:1. In the currently preferred form, the minimum diameter of the pressure pulse passage 80, 124 and the air passage 20, 102, 112, 122, 138, 168 may each vary between about 0.010 to 0.2 of an inch as desired for a particular application. Preferably, the air passage 20, 102, 112, 122, 138, 168 is smaller than the pressure pulse passage 80, 124 to minimize any negative affects such as dilution or attenuation of the pressure pulse signal applied to the diaphragm in the pressure pulse chamber 18. The air passage may be maintained open all the time, or desirably be closed by a valve separate from and optionally actuated by the throttle valve or by the throttle valve itself which may also act as an air passage valve such as when the throttle valve is moved between its idle and wide open positions. Desirably, a rotary type throttle valve, butterfly type valve or slide type valve, in addition to substantially any other valving arrangement, may be used for this purpose.

Figure 9:
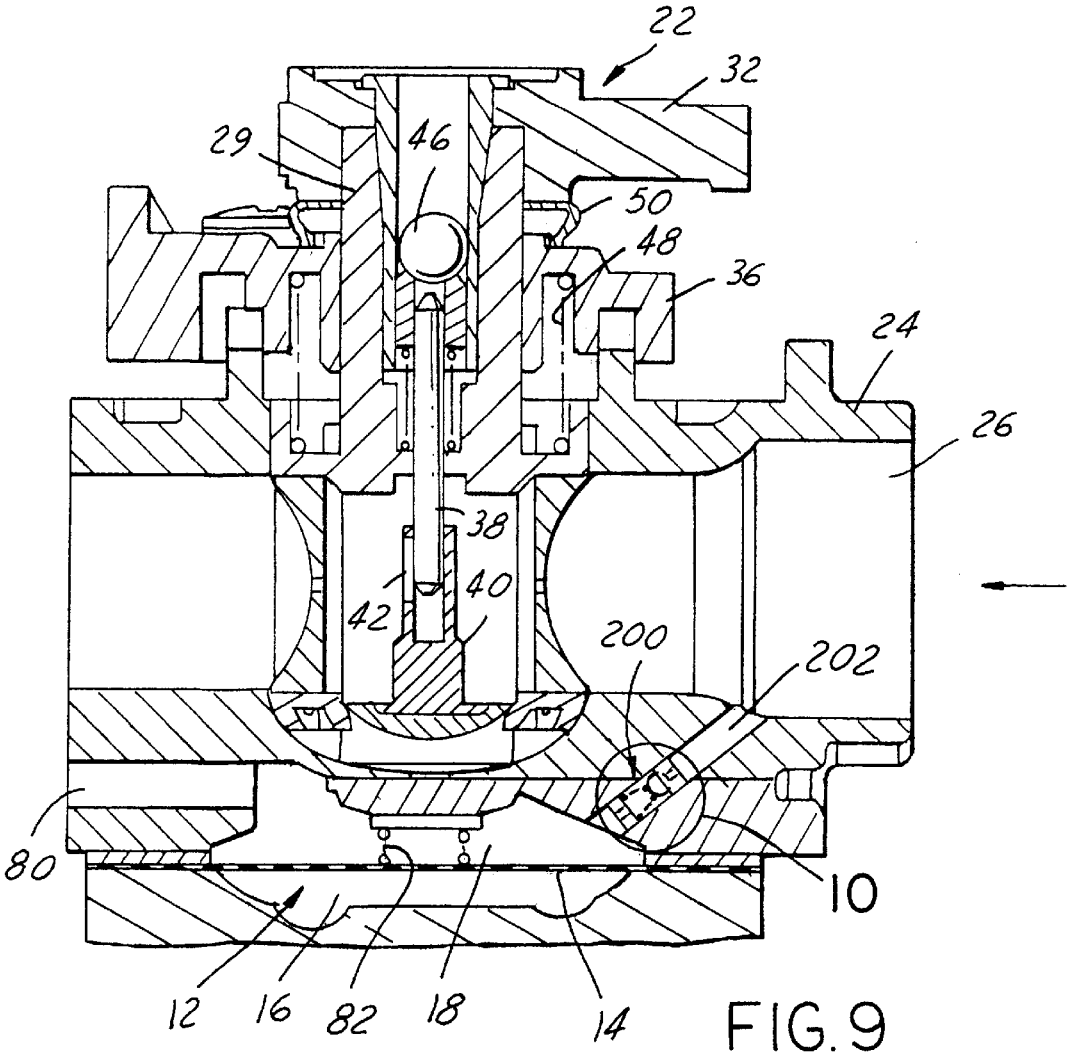
FIG. 9 is a sectional view of a carburetor according to a seventh embodiment of the invention.
Figure 10:
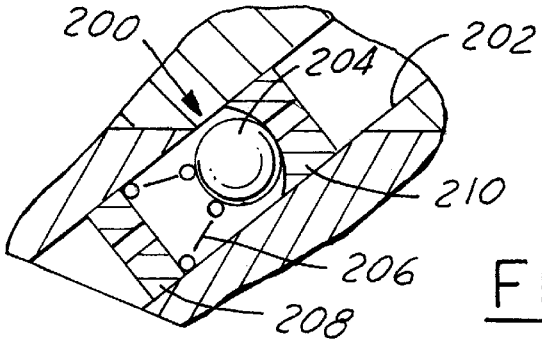
FIG. 10 is an enlarged fragmentary sectional view illustrating a check valve which may be used with the carburetor of FIG. 9.

For example, as shown in FIGS. 9 and 10, a check valve 200 may be provided in the air passage 202 to selectively close the air passage 202 during certain engine operating conditions and when the engine is not operating. Desirably, with the check valve 200 closed when the engine is not operating, upon initial cranking of the engine to start it, the check valve 200 will be closed preventing air from flowing through the air passage 202. Accordingly, more air will flow through the fuel and air mixing passage 26, because no air will flow through the air passage 202, providing a richer fuel and air mixture to the engine to facilitate starting it. Upon starting of the engine and during idle and other low speed and low load operation of the engine, the check valve 200 will open due to the relatively large pressure drop across the check valve 200 at such engine operating conditions. As the engine speed increases towards wide-open throttle, the check valve 200 will close due to the decreased pressure differential across the check valve. Desirably, at high engine speed and high engine load operation, the check valve 200 is closed to prevent the application of the air signal from the fuel and air mixing passage 26 to the pressure pulse chamber 18 to prevent interference with the fuel pump operation during high speed engine operation.

Figure 11:
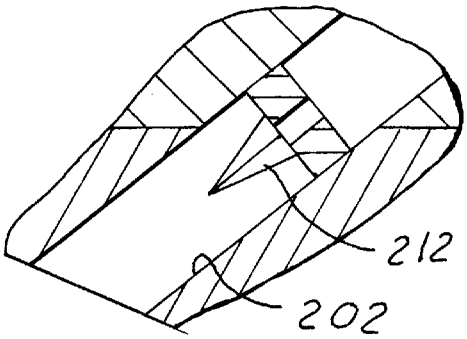
FIG. 11 is an enlarged fragmentary sectional view illustrating an alternate check valve which may be used with the carburetor.
Figure 12:
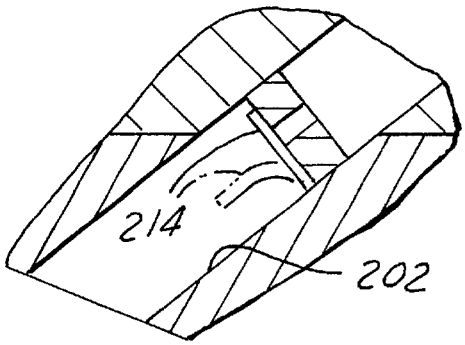
FIG. 12 is an enlarged fragmentary sectional view illustrating an alternate check valve which may be used with the carburetor.
Figure 13:
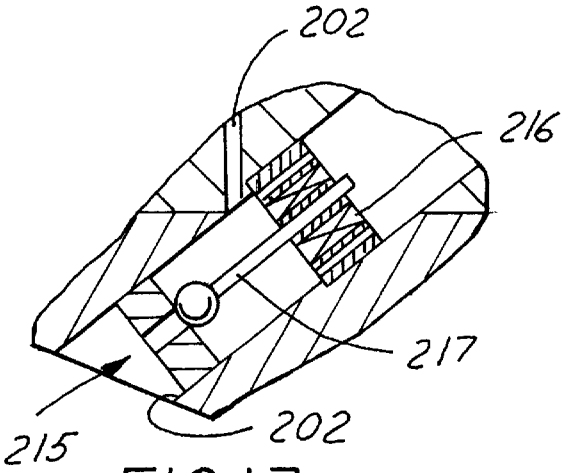
FIG. 13 is an enlarged fragmentary sectional view illustrating an alternate check valve which may be used with the carburetor.
Figure 14:
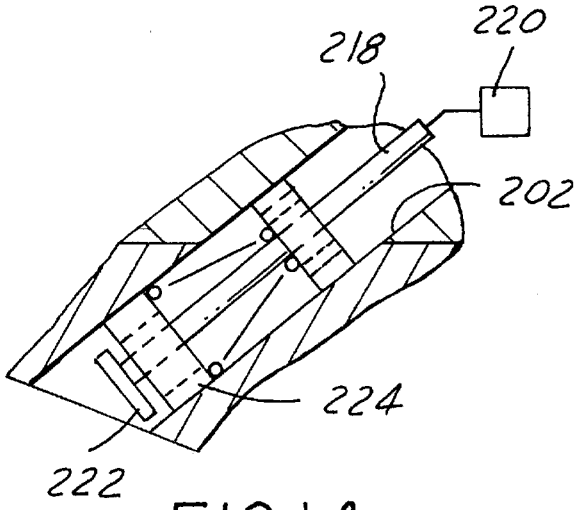
FIG. 14 is an enlarged fragmentary sectional view illustrating an alternate check valve which may be used with the carburetor.

The check valve 200 may take on many forms including a yieldably biased ball 204 or other valve head as shown in FIG. 10. Such a check valve may have a spring 206 trapped between a spring seat 208 and the valve ball 204 or valve head to bias the ball 204 towards a valve seat 210, all disposed within the air passage 202. As shown in FIG. 11, the check valve may comprise a duck bill type check valve 212 with such check valve 212 calibrated to open at a desired pressure differential across the check valve. The check valve, as shown in FIG. 12, can also be a flapper-type check valve 214 which may be spring biased if desired. As shown in FIG. 13, the check valve could be a solenoid-actuated valve 215 having a coil 216 and a plunger 217 responsive to a signal provided from the ignition system or a switch activated by and responsive to movement of the throttle valve, or the solenoid may be responsive to the speed of the engine. Finally, as shown in FIG. 14, the check valve may comprise a capillary tube 218 communicated with a heat sensing bulb 220 on the engine cylinder or on the engine exhaust system, such as on the engine muffler. The heat sensing bulb 220 is operable to displace a valve head 222 relative to a valve seat 224 to the control the air flow through the air passage 202 as described with reference to the other embodiments. Of course, still other valves or other fluid control arrangements may be used to control the flow of fluid through the air passage 202 as desired.

Accordingly, each of the check valve configurations comprises an air passage valve movable between open and closed positions to selectively communicate an air supply with the pressure pulse chamber. Each valve or other flow control arrangement is capable of closing the air passage 202 to facilitate initial starting of the engine. The check valves are preferably also opened at idle and other low speed and low load engine operating conditions when there is a sufficient pressure drop across them and are closed at higher engine operating speeds and loads when there is a lower pressure differential across them. Desirably, this provides an air flow to the pressure pulse chamber 18 at low engine operating speeds and prevents such air flow at higher engine operating speeds when the fuel pump needs to pump a greater quantity of fuel and hence, it is undesirable to dilute the pressure pulse signal which drives the fuel pump.

We claim:

1. A carburetor comprising:

a body;

a fuel pump diaphragm carried by the body and defining in part a fuel chamber on one side of the fuel pump diaphragm and a pressure pulse chamber on the other side of the fuel pump diaphragm, the pressure pulse chamber communicating with a pressure pulse source to provide pressure pulses in the pressure pulse chamber to actuate the fuel pump diaphragm;

an air passage communicating at one end with a fresh air supply and at its other end with the pressure pulse chamber to provide a supply of air to the pressure pulse chamber; and in operation, the pressure pulse source causes air from the air passage to flow through the pressure pulse chamber to at least reduce the amount of liquid fuel therein.

2. The carburetor of claim 1 wherein the air passage communicates at said other end with the lowest portion of the pressure pulse chamber relative to the standard operating position of the carburetor.

3. The carburetor of claim 1 which also comprises an air passage valve carried by the body in communication with the air passage and being movable between a first position permitting air flow through the air passage and a second position at least substantially restricting air flow through the air passage.

4. The carburetor of claim 3 which also comprises a throttle valve carried by the body for movement between an idle position and a wide open position and the air passage valve is actuated by the throttle valve so that when the throttle valve is in its idle position the air passage valve is in its first position and when the throttle valve is in its wide open position the air passage valve is in its second position.

5. The carburetor of claim 4 wherein the air passage valve is defined in part by a portion of the throttle valve.

6. The carburetor of claim 4 wherein the throttle valve is a butterfly valve with a valve head carried by a valve shaft rotatably carried by the body.

7. The carburetor of claim 4 wherein the throttle valve is a barrel valve rotatably carried by the body and having a through bore.

8. The carburetor of claim 4 wherein the throttle valve is a slide valve slidably carried by the body.

9. The carburetor of claim 3 wherein the air passage valve comprises a check valve in communication with the air passage which selectively prevents application of the air supply to the pressure pulse chamber.

10. The carburetor of claim 9 wherein the check valve prevents application of the air supply to the pressure pulse chamber when the engine is not operating and upon initial starting of the engine.

11. The carburetor of claim 9 wherein the check valve prevents application of the air supply to the pressure pulse chamber at wide open throttle operating conditions of the carburetor and permits application of the air supply to the pressure pulse chamber at idle operating conditions of the carburetor.

12. The carburetor of claim 11 wherein the check valve is responsive to a pressure differential across the check valve and is moved to an open position permitting fluid flow therethrough when a sufficient pressure differential exists across the valve.

13. The carburetor of claim 11 which also comprises a fuel and air mixing passage formed at least in part in the body and a throttle valve movable between idle and wide open positions to control fluid flow through the fuel and air mixing passage, and wherein the check valve is actuated by a solenoid that is responsive to the position of throttle valve.

14. The carburetor of claim 11 which also comprises a fuel and air mixing passage formed at least in part in the body and a throttle valve movable between idle and wide open positions to control fluid flow through the fuel and air mixing passage, and wherein the check valve is actuated by a solenoid that is responsive to the speed of the engine.

15. The carburetor of claim 3 which also comprises a fuel and air mixing passage formed at least in part in the body and a throttle valve movable between idle and wide open positions to control fluid flow through the fuel and air mixing passage, and wherein the air passage valve is separate from the throttle valve and is disposed within the air passage.

16. The carburetor of claim 1 which also comprises a fuel and air mixing passage formed through the body in communication with a low pressure source at one end and an air supply at its other end, and a pressure pulse passage communicating at one end with the pressure pulse chamber and at its other end with the pressure pulse source.

17. The carburetor of claim 16 wherein the pressure pulse passage communicates with the fuel and air mixing passage at generally the highest point of the fuel and air mixing passage relative to the standard operating position of the carburetor.

18. The carburetor of claim 1 which also comprises a pressure pulse passage communicating the pressure pulse chamber with the pressure pulse source and the ratio of the minimum diameter of the air passage to the minimum diameter of the pressure pulse passage is between 0.05:1 and 1.5:1.

19. The carburetor of claim 1 which also comprises a pressure pulse passage communicating the pressure pulse chamber with the pressure pulse source and the ratio of the minimum diameter of the air passage to the minimum diameter of the pressure pulse passage is between 0.25:1 and 1:1.

20. A carburetor for a four-stroke engine, comprising:

a body having a fuel and air mixing passage through which a fuel and air mixture is provided to the four-stroke engine;

a throttle valve carried by the body and movable between idle and wide open positions to control fluid flow through the fuel and air mixing passage;

a fuel pump diaphragm carried by the body and defining a fuel chamber on one side of the fuel pump diaphragm and a pressure pulse chamber on the other side of the fuel pump diaphragm, the pressure pulse chamber communicating with the four-stroke engine to provide pressure pulses in the pressure pulse chamber to actuate the fuel pump diaphragm;

an air passage communicating an air supply with the pressure pulse chamber, a flow control valve communicating with the air passage and actuated by the throttle valve so that when the throttle valve is in its idle position a generally free flow of fluid is permitted through the air passage into the pressure pulse chamber and when the throttle valve is in its wide open position the flow of fluid through the air passage is at least substantially restricted; and the throttle valve comprises a valve head and a valve shaft which carries the valve head and which is rotatably carried by the body to move the valve head between idle and wide open positions, the valve shaft has a hole therethrough which defines a portion of the flow control valve, and communicates with the air passage when the throttle valve is in its idle position and is rotated out of communication with the air passage when the throttle valve is moved to its wide open position.

21. The carburetor of claim 20 wherein the throttle valve has a generally cylindrical shaft rotatably carried by the body and having a through bore selectively and rotatably aligned with the fuel and air mixing passage when it is rotated between its idle and wide open positions.

22. The carburetor of claim 21 which also comprises a cam and a follower assembly operably associated with the throttle valve to cause axial movement of the shaft in response to the rotational movement of the throttle valve between its idle and wide open positions with the axial movement of the shaft selectively opening and closing the air passage to control fluid flow therethrough.

23. The carburetor of claim 20 wherein the throttle valve has a shaft slidably carried by the body for movement between an idle position restricting fluid flow through the fuel and air mixing passage and a wide open position permitting an essentially unrestricted fluid flow through the fuel and air mixing passage with the slidable movement of the shaft also selectively actuating the fluid flow control valve.

24. The carburetor of claim 20 wherein the air passage enters the pressure pulse chamber generally at the lowest point of the pressure pulse chamber relative to the standard operating position of the carburetor.

25. The carburetor of claim 20 which also comprises a pressure pulse passage communicating with the engine and with the pressure pulse chamber.

26. The carburetor of claim 25 wherein the fuel and air mixing passage communicates at one end with the engine and the pressure pulse passage communicates with the engine through the fuel and air mixing passage.

27. The carburetor of claim 26 wherein the pressure pulse chamber communicates with the fuel and air mixing passage at substantially the highest point in the fuel and air mixing passage relative to the standard operating position of the carburetor.

28. A carburetor for an internal combustion engine, comprising:

a body having a fuel and air mixing passage through which a fuel and air mixture is provided to an intake of the engine;

a throttle valve carried by the body and movable between idle and wide open positions to control fluid flow through the fuel and air mixing passage;

a fuel pump carried by the body and having a diaphragm defining in part a fuel chamber on one side of the diaphragm and a pressure pulse chamber on the other side of the diaphragm;

the pressure pulse chamber communicating with the engine to provide pressure pulses in the pressure pulse chamber to actuate the fuel pump diaphragm;

an air passage communicating a fresh air supply with the pressure pulse chamber to provide a supply of air to the pressure pulse chamber;

a flow control valve communicating with the air passage and operably connected with the throttle valve so that when the throttle valve is in its idle position, the flow control valve is open to permit air to flow through the air passage and into the pressure pulse chamber and when the throttle valve is in its wide open position, the flow of air through the air passage and into the pressure pulse chamber is at least substantially restricted; and in operation, when the flow control valve is opened, the pressure pulse source causes air from the air passage to flow through the pressure pulse chamber to at least reduce the amount of liquid fuel therein.

29. The carburetor of claim 28 wherein the air passage communicates with substantially the lowest portion of the pressure pulse chamber relative to the standard operating position of the carburetor.

30. The carburetor of claim 28 wherein the fuel and air mixing passage is configured to communicate at one end with the intake of the engine and the pressure pulse passage communicates with the engine through the fuel and air mixing passage.

31. The carburetor of claim 30 wherein the pressure pulse chamber communicates with the fuel and air mixing passage at substantially the highest point in the fuel and air mixing passage relative to the standard operating position of the carburetor.

32. The carburetor of claim 28 wherein the flow control valve comprises a check valve which is closed when the engine is not operating, closed upon initial cranking to start the engine, when the engine is operating and the throttle valve is in its idle position is open to permit air to flow through the air passage into the pressure pulse chamber, and when the engine is operating and the throttle is in its wide open position closes to at least substantially restrict the flow of air from the air passage through the pressure pulse chamber.

* * * * *